US007328667B1

(12) United States Patent
Ryan et al.

(10) Patent No.: US 7,328,667 B1
(45) **Date of Patent: *Feb. 12, 2008**

(54) THREE DIMENSIONAL PLATED DECK

(75) Inventors: Thomas G. Ryan, North Huntingdon, PA (US); David F. Landis, Murrysville, PA (US)

(73) Assignee: Epic Metals Corporation, Rankin, PA (US)

( * ) Notice: Subject to any disclaimer, the term of this patent is extended or adjusted under 35 U.S.C. 154(b) by 24 days.

This patent is subject to a terminal disclaimer.

(21) Appl. No.: 11/516,070

(22) Filed: Sep. 6, 2006

Related U.S. Application Data

(63) Continuation of application No. 11/084,932, filed on Mar. 21, 2005, now Pat. No. 7,146,920.

(51) Int. Cl.
*B63B 3/00* (2006.01)

(52) U.S. Cl. ..... 114/85; 52/177; 52/731.3

(58) Field of Classification Search ..... 114/65 R, 114/85, 263, 264, 267, 343; 52/177, 489.1, 52/489.2, 731.1, 731.3
See application file for complete search history.

(56) References Cited

U.S. PATENT DOCUMENTS

| | | | | |
|---|---|---|---|---|
| 2,090,483 | A | 8/1937 | Mendez | |
| 2,899,028 | A | 8/1959 | Walker | |
| 3,397,497 | A | 8/1968 | Shea et al. | |
| 4,030,265 | A | 6/1977 | Allgood | |
| 4,453,349 | A | 6/1984 | Ryan | |
| 5,172,527 | A | 12/1992 | Ault | |
| 5,205,098 | A | 4/1993 | Landis et al. | |
| 5,259,157 | A | 11/1993 | Ault | |
| 5,735,097 | A | 4/1998 | Cheyne | |
| 6,301,842 | B1 | 10/2001 | Chaney et al. | |
| 6,691,482 | B1 | 2/2004 | Ault | |
| 7,146,920 | B1 * | 12/2006 | Ryan et al. | 114/85 |

OTHER PUBLICATIONS

Epic Archdeck®—Curved Roof Deck Ceiling Systems, Product Brochure, 2003.
Welcome to Fry Reglet—Architectural Metals, on-line product description, Jan. 1, 2004; http://fryreglet.com/new/fgallery.html.

* cited by examiner

*Primary Examiner*—Lars A. Olson
(74) *Attorney, Agent, or Firm*—The Webb Law Firm

(57) ABSTRACT

A deck assembly includes a plurality of deck panels in a side-by-side and end-by-end relationship. The deck panels include a support having a pair of opposed sides, opposed ends, and an arcuate portion having a convex surface and an opposite concave surface between and connected to a pair of spaced extensions. An elongated structural cover is positioned over the arcuate portion and attached to the support. The cover provides structural stability to the deck panel. Optionally, layers of insulation or a layer of concrete overlays the structural cover and exposed portions of the support between the covers. Optionally, the deck assembly can be made of acoustical deck panels.

4 Claims, 8 Drawing Sheets

THREE DIMENSIONAL PLATED DECK

CROSS-REFERENCE TO RELATED APPLICATION

This application is a continuation of U.S. patent application Ser. No. 11/084,932, filed Mar. 21, 2005 now U.S. Pat. No. 7,146,920, which is hereby incorporated by reference in its entirety.

BACKGROUND OF THE INVENTION

1. Field of the Invention

This invention relates to an arcuate deck panel and, more particularly, to an arcuate deck panel having an elongated arcuate portion having an upper concave surface and/or upper convex surface portion, and an elongated structural member covering upper surface of the arcuate portion to provide the arcuate deck panel with primary load-carrying capabilities.

2. Description of the Presently Available Technology

The construction of convention centers, arenas, office buildings, and other major structures normally uses deck panels assembled in a side-by-side and/or end-to-end relationship to facilitate the construction of the structure interior. In general, the deck panel has a top surface and a bottom surface such that, when deck panels are assembled together, the upper surface provides the floor or roof support and the bottom surface provides the ceiling or the ceiling support. Other types of panels give a plated appearance. Although the presently available panels are acceptable for use in the construction of floors and/or ceilings, there are limitations, particularly on the ornamental appearance of load-carrying panels.

As is appreciated by those skilled in the art, it would be advantageous to provide arcuate deck panels that are simple in construction that can provide a pleasing ceiling appearance to the observer and are versatile in ornamental design capabilities, while maintaining their load-carrying capabilities.

SUMMARY OF THE INVENTION

This invention relates to a deck panel. In one non-limiting embodiment, the deck panel includes a support having a pair of opposed sides and opposed ends and an arcuate portion having a convex surface and an opposite concave surface between and connected to a pair of spaced extensions, and an elongated structural cover over the arcuate portion and supported on the extensions.

Additional non-limiting embodiments of the invention include the support (including the arcuate portion) and/or the structural cover made of metal or a material selected from the group of steel, stainless steel and aluminum, plastic, and/or fiberglass-reinforced plastics. The structural cover can have a pair of spaced legs joined to a base to provide the cover in cross section with a generally inverted U-shape, the legs of the cover having extensions which are supported on the extensions of the support, with the extensions of the cover optionally spaced from the side of the support, and the cover overlaying the concave surface or the convex portion of the arcuate support. In a further non-limiting embodiment of the invention, the extensions each have a first surface and an opposite second surface, with the arcuate portion on the first surface of the extensions and the arcuate portion has an arcuate shape having a center spaced from the second surface of the extensions.

The invention further relates to an improved deck assembly. The prior art deck assemblies that are improved include a plurality of deck panels assembled in one or more of the manner selected from the group of side-by-side, end-by-end, and combinations thereof, and secured to supports. The improvement includes at least one of the panels of the invention discussed above.

The invention still further relates to a method for making a ceiling from deck panels and includes the steps of forming a deck panel having a support having a pair of opposed sides and opposed ends, and an arcuate portion having a convex surface and an opposite concave surface between and connected to a pair of spaced extensions, and an elongated structural cover over the arcuate portion and supported on the extensions, and attaching said panel to a support.

In a non-limiting embodiment of the invention, the forming and attaching steps are practiced by attaching the support of the deck panel to the support, with the concave surface facing downward becoming an exposed surface, and placing the cover over the convex surface which becomes the non-exposed surface. Alternatively, the convex surface can face downward becoming an exposed surface, and the cover can be placed over the concave surface, which becomes the non-exposed surface. Preferably, the deck panels are pre-assembled at an assembly site such as a factory, although it is possible to assemble the panels in the field.

The present invention provides a pleasing ceiling appearance while maintaining desirable load-carrying capabilities and a substantially flat upper surface. The ceiling is made of panels having exposed arcuate surfaces which provide greater exposed surfaces to the ceiling lending itself to improved acoustical sound absorption design.

DESCRIPTION OF THE PREFERRED EMBODIMENTS

Figure 1A:
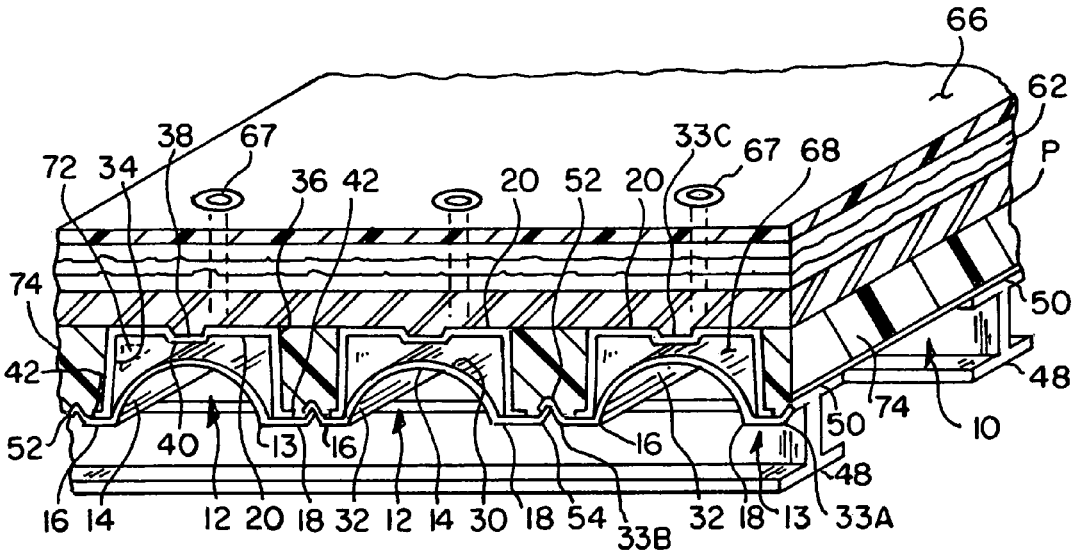
FIG. 1A is an orthogonal view, in cross section, of a portion of a non-limiting roof assembly of the invention having a non-limiting embodiment of deck panels incorporating features of the invention and insulation over the deck panels.

As used herein, spatial or directional terms, such as "inner", "outer", "left", "right", "up", "down", "horizontal", "vertical", and the like, relate to the invention as it is shown in the drawing figures. However, it is to be understood that the invention can assume various alternative orientations and, accordingly, such terms are not to be considered as limiting. Further, all numbers expressing dimensions, physical characteristics, and so forth, used in the specification and claims are to be understood as being modified in all instances by the term "about". Accordingly, unless indicated to the contrary, the numerical values set forth in the following specification and claims can vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 1 to 6.7, or 3.2 to 8.1, or 5.5 to 10.

Before discussing several non-limiting embodiments of the invention, it is understood that the invention is not limited in its application to the details of the particular non-limiting embodiments shown and discussed herein since the invention is capable of other embodiments. Further, the terminology used herein to discuss the invention is for the purpose of description and is not of limitation. Still further, in the following discussion, unless indicated otherwise, like numbers refer to like elements.

Figure 1B:
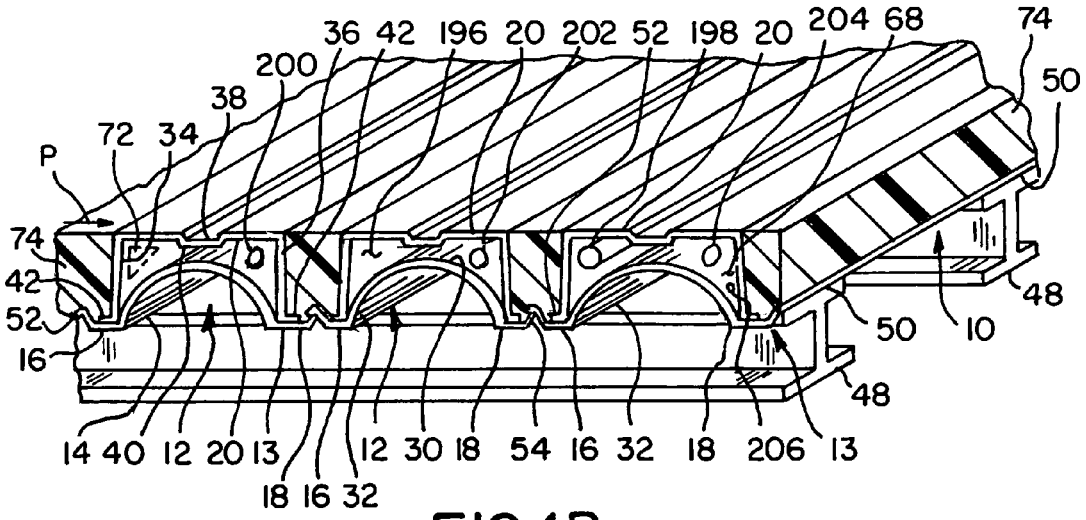
FIG. 1B is an orthogonal view, in cross section, similar to that shown in FIG. 1A, showing various hardware contained within the deck panels.
Figure 2:
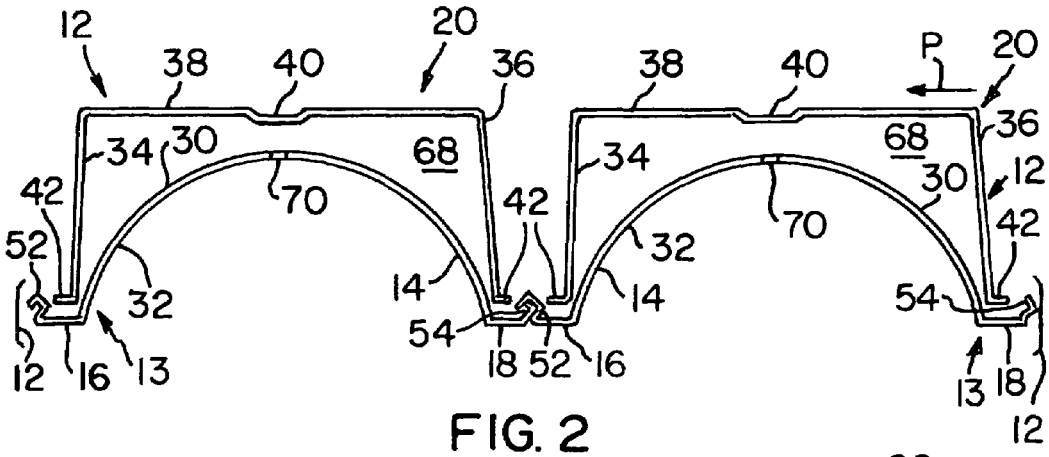
FIG. 2 is an exploded end view of the support and structural cover shown in FIG. 1B, with the support and structural cover in spaced relationship to one another.

Shown in FIG. 1A is a portion of a non-limiting embodiment of a ceiling and roof three dimensional plated deck assembly 10. The deck assembly 10 includes a plurality of deck panels 12 joined together in any usual manner. As can be seen in FIGS. 1A-2, each of the deck panels 12 includes a support 13 having an elongated arcuate portion 14 having an extension 16 on one side of the arcuate portion 14 and an extension 18 on the other side of the arcuate portion 14, and an elongated structural cover or hat 20 over the arcuate portion 14. The arcuate portion 14 of the deck panel 12 has an upper facing convex surface 30 and an opposite lower facing concave surface 32. The deck panels 12 have a pair of opposed sides 33A and 33B and opposed ends. Only one opposed end 33C is shown. The other opposed end is not shown but is at the other end of the deck panel 12 which extends in the page.

Figure 9A:
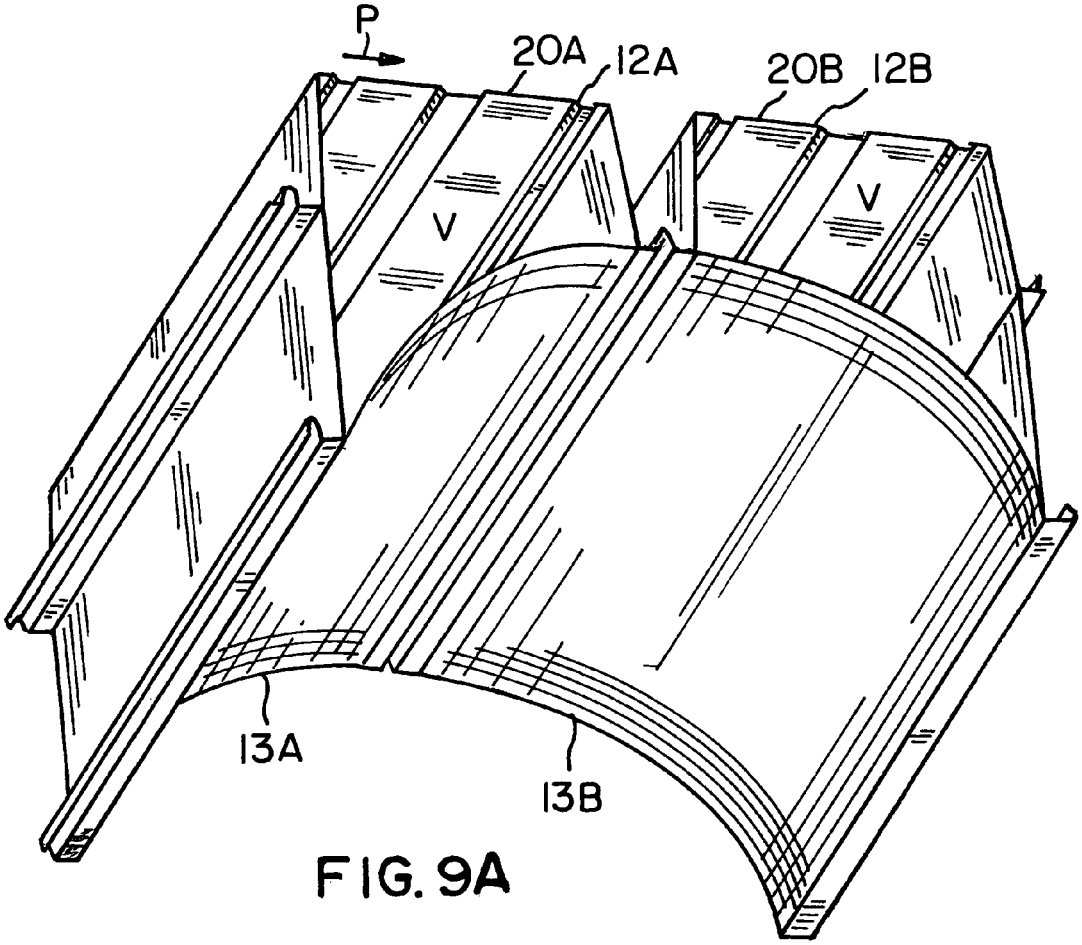
FIGS. 9A-9G show perspective views of deck assemblies made in accordance with the present invention.
Figure 6:
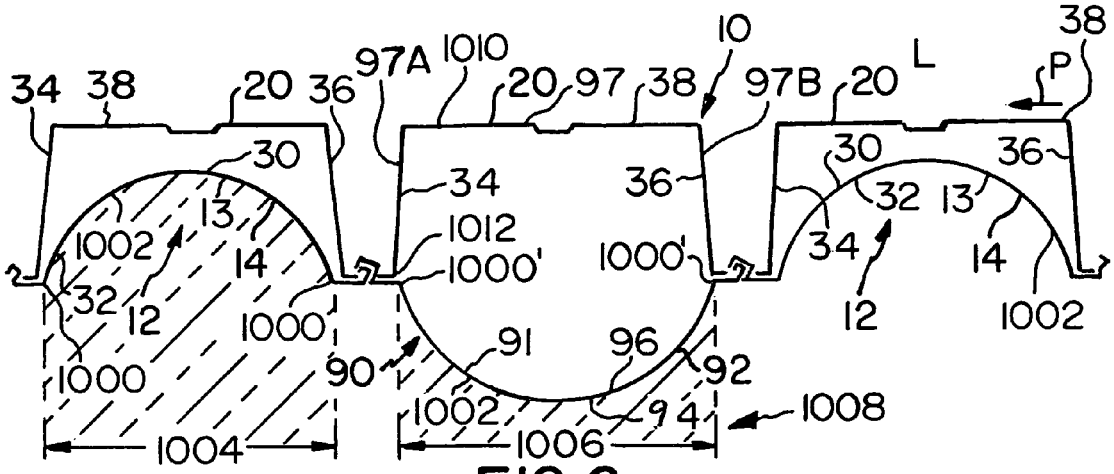
Figure 7:
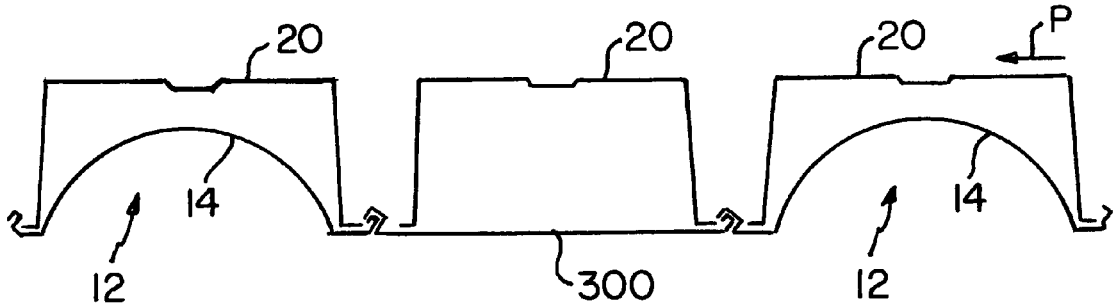
Figure 8:
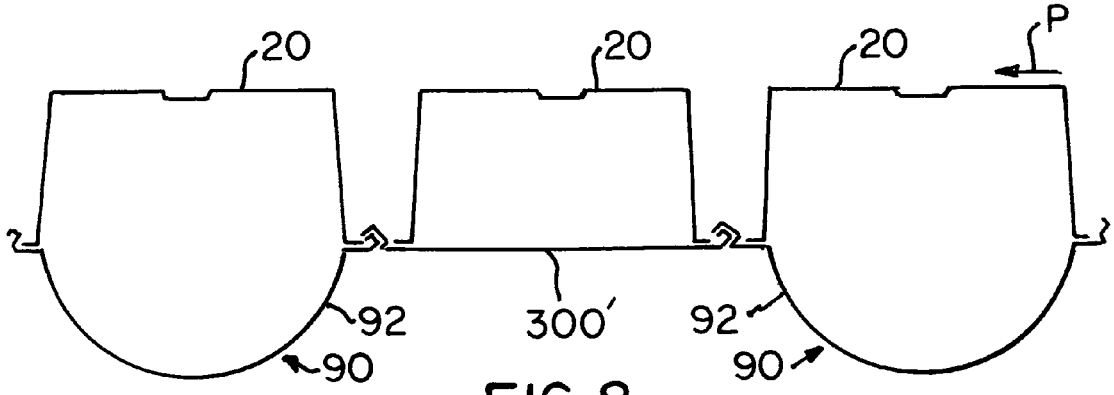
Figure 9B:
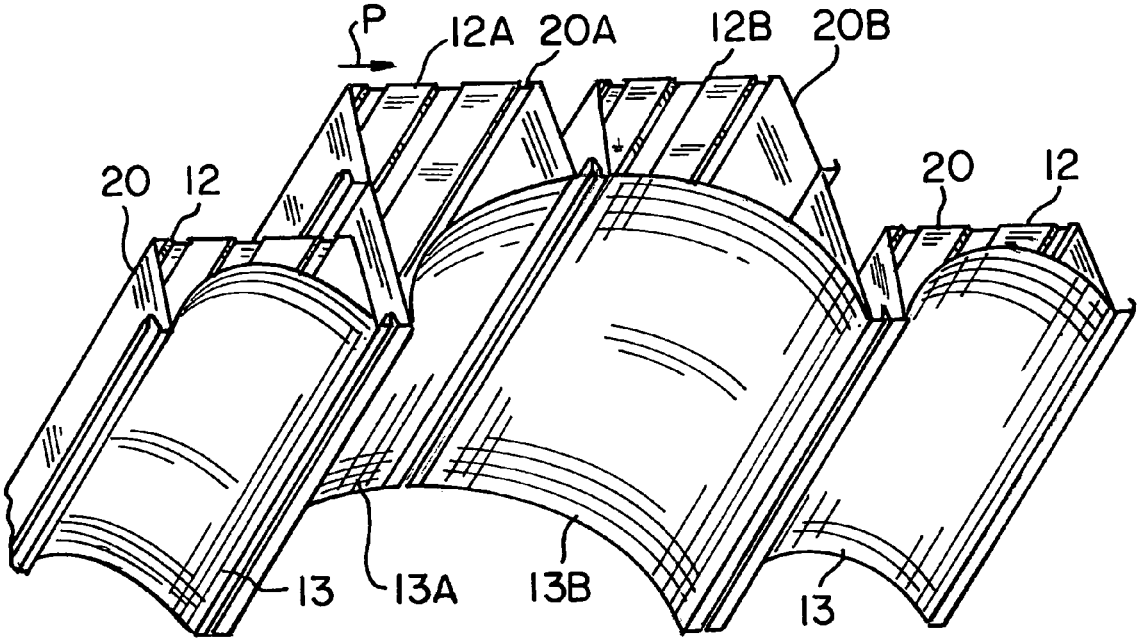
Figure 9C:
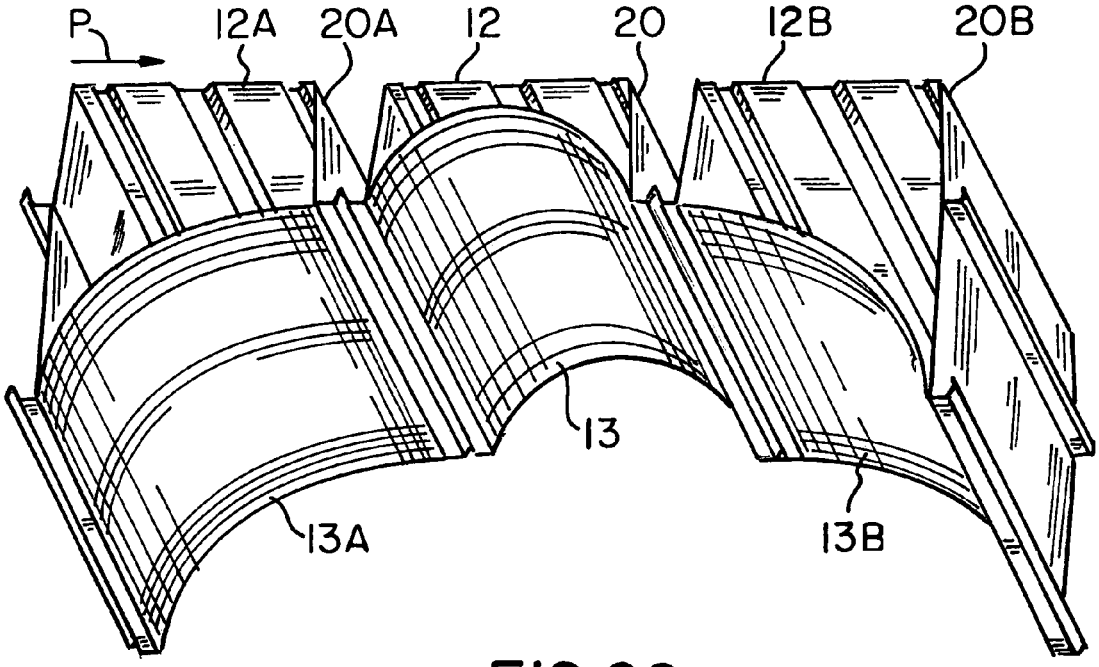
Figure 9D:
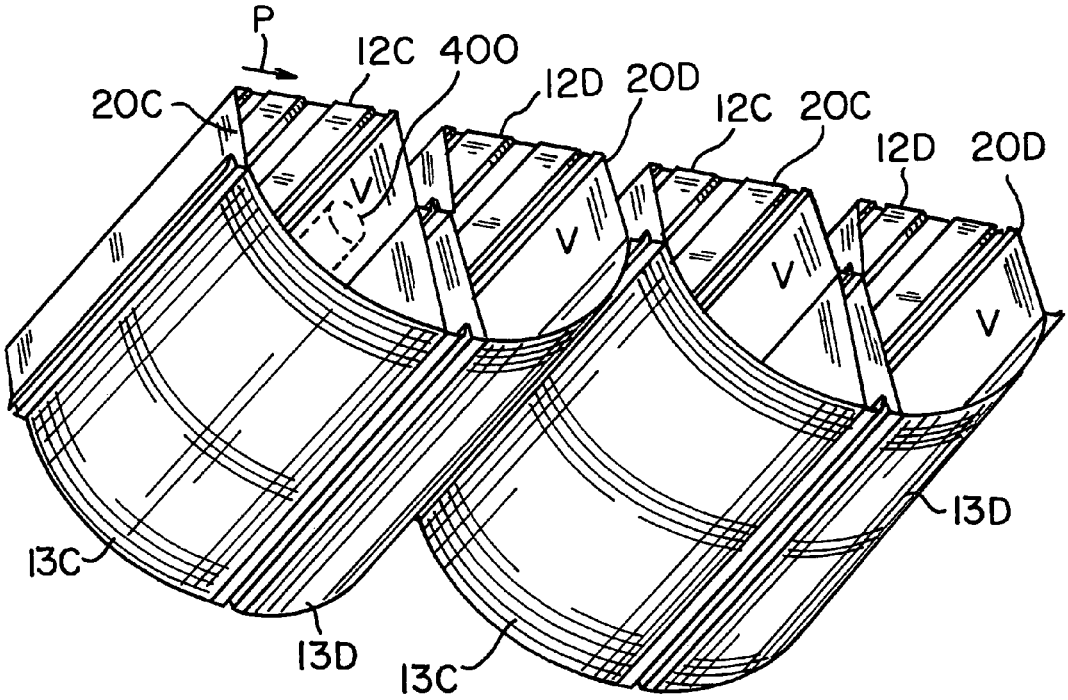
Figure 9E:
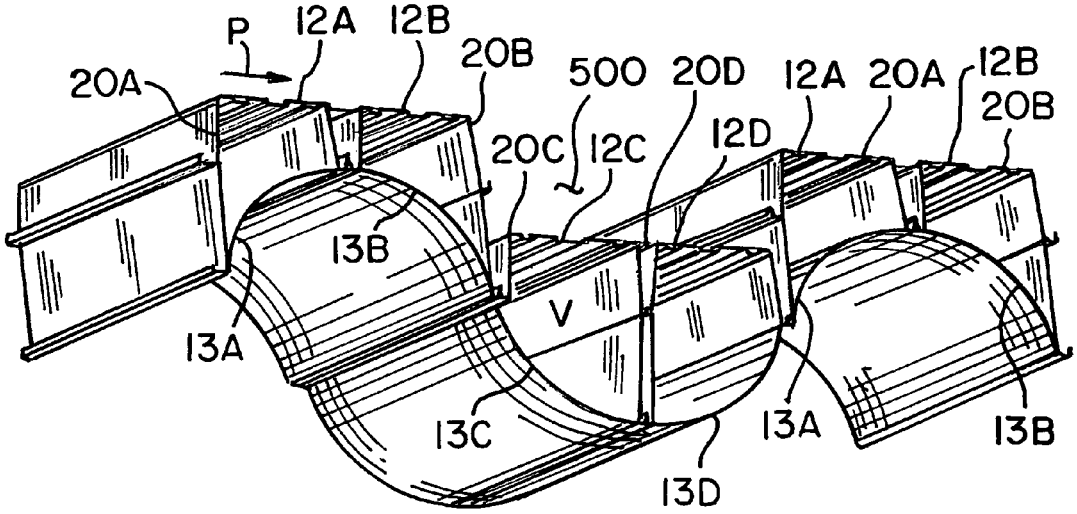
Figure 9F:
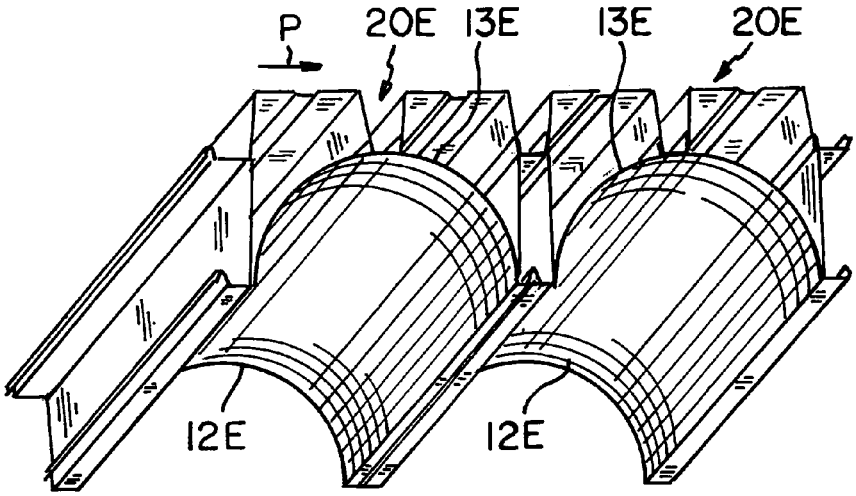

Referring to FIGS. 1A-2 and particularly FIG. 2, the elongated structural cover or hat 20 has a pair of spaced legs 34 and 36 joined to a base 38 providing the cover 20 with an inverted U-shaped or W-shaped cross section (such as shown in FIG. 9F) or any geometric shaped cross section or any other shaped cross section to mount the structural cover 20 over the upper convex surface 30 of the arcuate portion 14 of the deck panel 12. Although not limiting to the invention, center portion of the base 38 of the structural cover 20 is provided with an elongated groove 40 (see FIG. 2) to indicate the center of the structural cover 20 and the appreciated center or highest point of the convex surface 30 of the arcuate portion 14. In a non-limiting embodiment of the invention, each end of the legs 34 and 36 of the structural cover 20 has an outward extension 42 to minimize or eliminate edge forces acting on the extensions 16 and 18 of the support 13 of the deck panel 12. The extensions 16 and 18 of the support 13, and the extension 42 of the legs 34 and 36 of the structural cover 20, are shown flat or lying in a horizontal plane. The invention, however, is not limited thereto and the extensions 16, 18, and 42 can have any contour. Preferably, in the practice of the invention but not limiting thereto, the extensions 16 and 18, and the extension 42, have complementary surfaces to seat the structural cover 20 on the support 13.

The structural cover 20, in conjunction with or without the support 13, provides the deck panel 12 of the invention with sufficient load-carrying capacity in a manner discussed below to support the dead loads of thermal insulation, acoustical insulation and/or concrete before it solidifies and live loads.

Referring back to FIGS. 1A and 1B, the deck assembly 10 is positioned on a structural frame, i.e., transversely-extending support beams or purlins 48 spaced a predetermined distance apart, e.g., but not limiting to the invention, on 6 feet to 50 feet centers, with the centers corresponding to the structural load-carrying capacity of the designed panel 12, and are connected to the building superstructure in any usual manner recognized in the art. The structural frame can include any type of load-bearing structure, including framework and walls. The deck panels 12 are connected to the purlins 48 in any usual manner, e.g., but not limiting to the invention, by rivets, screws, and/or welds 50. The deck panels 12 thereby form the arcuate deck assembly 10.

As can be appreciated, the support 13 and the structural cover 20 of the deck panel 12 can be made of the same material or different material, and can be made of any structural type material, e.g., but not limiting the invention thereto, metal, e.g., but not limiting to the invention, steel, stainless steel and aluminum, plastic, fiberglass-reinforced plastics, just to name a few materials. In a non-limiting preferred practice of the invention, the support 13 and structural cover 20 are roll formed from steel coils of the appropriate gauge and coating.

The structural covers 20 and the arcuate supports 13 of the deck assembly 10 provide the load-carrying capacity of the deck assembly 10. More particularly, as shown in FIG. 2, the legs 34 and 36 of the structural cover 20 support the end portions of the base 38 of the structural cover 20.

In a non-limiting embodiment of the invention, the structural cover 20 is secured to the support 13 in any usual manner, e.g., by welding, sheet metal screws, adhesive, rivets, or nut and bolt arrangements.

As shown in FIG. 2, the extensions 16 and 18 of the support 13 of the deck panel 12 terminate along their longitudinal edges in side laps 52 and 54. Side laps 52 and 54 can be any type of conventional side laps which are well known in the art. More particularly, the side lap 52 of the extension 16 has an extending member, and the side lap 54 of the extension 18 has a receiving member. With this arrangement, the side lap 52 of the extension 16 of one of two adjacent deck panels 12 is interlocked with, or received in, the side lap 54 of the extension 18 of the other one of the two adjacent panels so that adjacent ones of the deck panels 12 can be joined in side-by-side relationship as shown in FIGS. 1A, 1B and 2.

Referring back to FIG. 1A, although not limiting to the invention, in the instance where insulation is to be provided over the base 38 of the structural cover 20, the structural cover is covered with conventional thermal insulation 62.

The thermal insulation 62 is normally covered with a standard roofing material 66. The thermal insulation 62 is secured in place by any convenient manner, e.g., by threaded fastener and fastener plate assemblies 67, which passes through the roofing material 66 and the insulation 62, and is connected to the base 38 of the structural cover 20. Protruding ends of the fasteners of the fastener plate assemblies 67 are hidden by the support 13, even if the protruding ends of the fasteners pass through the structural cover 20.

As is appreciated by those skilled in the art, other forms of conventional ceiling, floor, or roof construction materials can be used in conjunction with non-limiting embodiments of the arcuate deck assembly 10 of the invention.

As shown in FIG. 1B, although not limiting to the invention, a space 68 bound by the interior surfaces of the structural cover 20 and the convex surface 30 of the arcuate portion 14 of the support 13 can be utilized, e.g. but not limiting the invention thereto, to move heating and cooling air 196 (see also FIG. 4) through the space 68 and through perforations 70 in the arcuate portion 14 of the support 13 and/or pass piping 198 (see also FIG. 4) and/or to mount detectors 200, such as smoke detectors 202 and/or noise detectors 204, and/or audio amplifiers 206 (see FIG. 1B). Further, as shown in FIGS. 1A and 1B, the invention contemplates mounting acoustic insulation 72 (in phantom) in the space 68 as shown for one deck panel in FIGS. 1A and 1B. Still further, the invention contemplates placing insulation and/or noise-absorbing material 74 between adjacent covers 20 as shown in FIG. 1B.

As shown in FIG. 1A, in the practice of the invention but not limited thereto, the cover 20 of one or more deck panels 12 is attached to the purlins 48 by welds 50. The structural cover 20 is positioned over the arcuate portion 14 of the support 13. Optionally, before placing the cover 20 over the arcuate portion 14, thermal insulation or noise-absorbing material 72 can be placed over the unexposed surface 30 of the arcuate portion 14 and, thereafter, the cover 20 placed over the thermal insulation or noise-absorption material 72. In that case, the arcuate portion 14 of the supports 13 includes perforations (not shown). After the structural cover 20 is placed over the arcuate portion 14, optionally, noise-absorbing material 74, shown in phantom, is placed between adjacent structural covers 20. The base 38 of the structural cover 20 is finished in any convenient manner, e.g., covering the base 38 of the structural cover 20 and any material 74 between adjacent structural covers 20, with thermal insulation 62, and the roofing material 66 as previously discussed, as shown in FIG. 1A.

Figure 3:
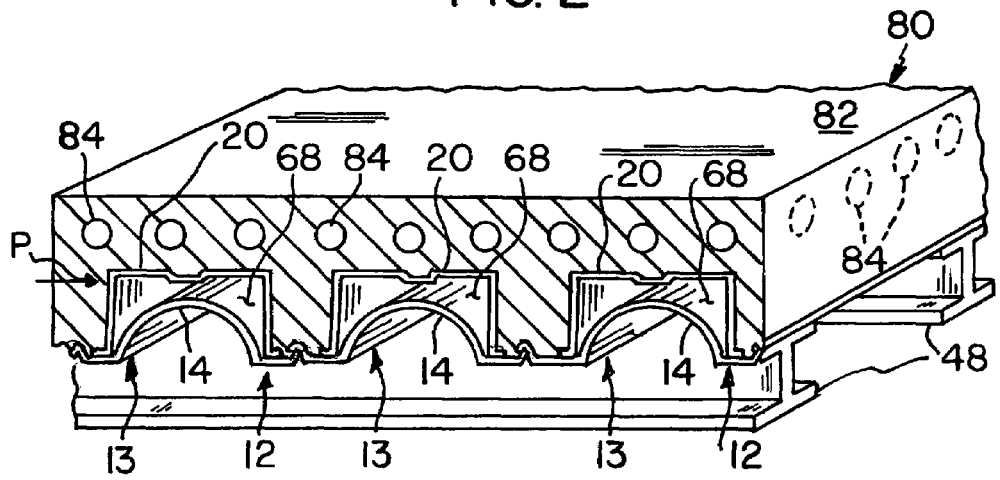
FIG. 3 is a view similar to the view of FIG. 1A of a portion of another non-limiting ceiling and floor assembly having concrete over the deck panels incorporating features of the invention.

With reference to FIG. 3, there is shown another non-limiting embodiment of an arcuate deck assembly 80 incorporating features of the invention. The arcuate deck assembly 80 includes a plurality of arcuate deck panels 12 joined together as previously discussed. Although in FIG. 3 there is no insulation material 72 shown in the space 68 as shown in FIG. 1A, it can be appreciated that insulation material can be provided in the space 68 of the deck panels 12 of the arcuate deck assembly 80. As can be appreciated by those skilled in the art, when the arcuate deck assembly is used as a composite floor or roof deck as shown for the deck assembly 80 of FIG. 3, the spans of the deck panel 12 and the purlins 48 are spaced according to the load. After the deck panels 12 are fixed in position on the purlins 48, concrete 82 is poured over the deck panels 12. Preferably, the deck panels are assembled at the assembly plant with the insulation material 72 in place. On-site assembly includes attaching the deck panels 12 to form a deck and, if necessary, attaching the other components, pouring concrete and/or attaching roofing material thereto. The structural cover 20 protects any components in the space 68 from the concrete 82 and prevents the poured concrete 82 from going through any perforations that are in the arcuate portion 14 of the support 13, e.g., perforations 70 as shown in FIG. 2, and provides primary structural support for its respective deck panel 12 while the concrete 82 sets. The concrete 82 substantially fills in the space between adjacent structural covers 20 to provide sufficient interlocking between the concrete 82 and panels 12. As can be appreciated, metal rods or bars 84 can be used as is known in the art to provide the concrete 82 with additional structural strength.

Figure 4:
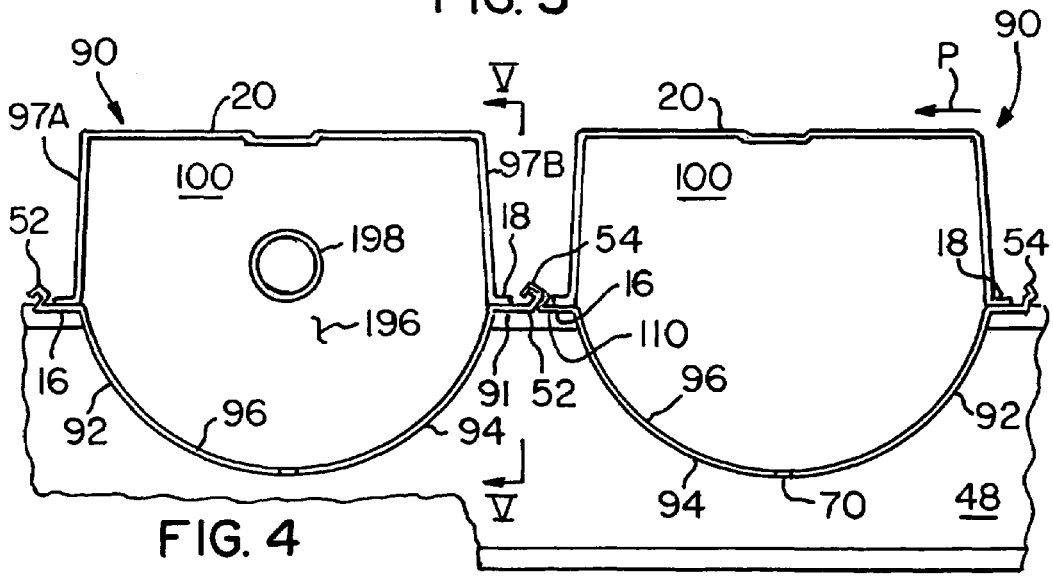
FIG. 4 is an end view of another non-limiting embodiment of a deck panel incorporating features of the invention.
Figure 5:
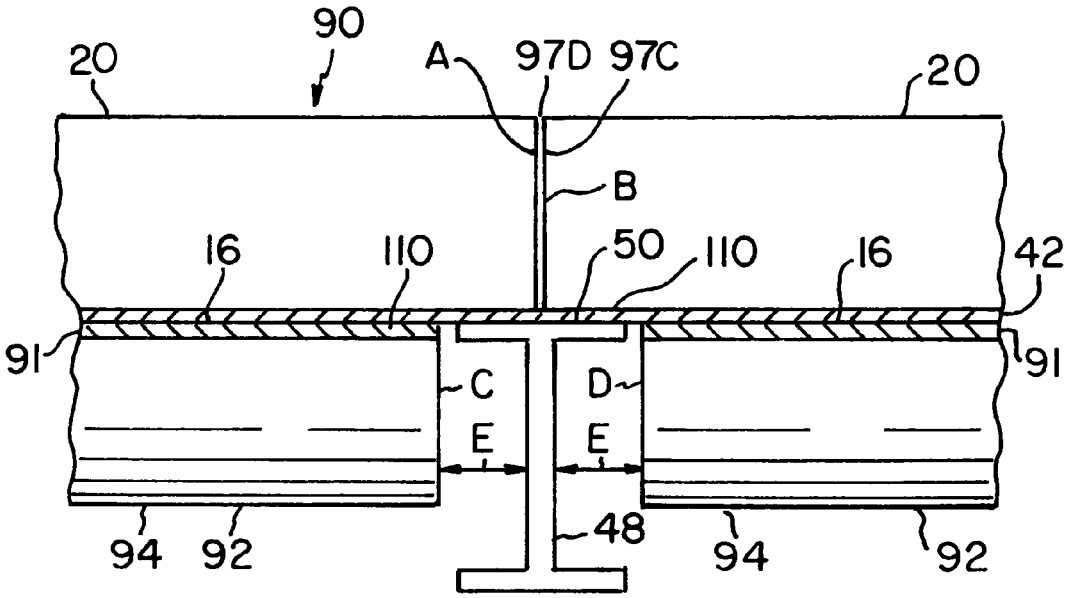
FIG. 5 is a view taken along lines 5-5 of FIG. 4.

With reference to FIGS. 4 and 5 there is shown a deck panel 90. Deck panel 90 is another non-limiting embodiment of the invention and includes a support 91 having an arcuate or arched portion 92 and the structural cover 20. The support 91 has a downward facing exposed convex surface 94 and an opposite upward facing unexposed concave surface 96 and the extensions 16 and 18. The deck panels 90 have a pair of opposed sides 97A and 97B as shown in FIG. 4 and opposed ends 97C and 97D shown in FIG. 5. The structural cover 20 overlays the arcuate portion 92 and provides a space 100 (shown in FIG. 4) between the cover 20 and arcuate portion 92, and is, preferably but not limited to the invention, secured in position in any convenient manner, e.g., by sheet metal screws, rivets, adhesive or welding, but preferably welding to achieve the composite structural strength of the cover and the arched portion 92.

Referring to FIG. 5, regarding the length of the supports 91 and 13 (not shown) and the structural cover 20, the structural cover 20 can be equal to, greater than or less than the length of the supports 91 and 13 (not shown). The invention also contemplates (although not shown) having the structural cover 20 overlap adjacent supports 91 or 13, e.g., an end portion of a structural cover extends over the arcuate portions 92 or 14 of one of a pair of adjacent supports 91 or 13, and the remaining portion of the structural cover 20 extends over the arcuate portions 92 or 14 of the other one of the pair of adjacent supports. As can be seen in FIG. 5, ends A and B of the structural covers 20 are adapted to abut each other. Ends C and D are offset a distance E from the ends A and B and define a recess for receipt of the purlin 48. Each of the structural covers 20 defines a load-bearing supporting surface 110 that rests on an upper flange of the purlin 48.

Referring to FIG. 4, as can be appreciated but not limited to the invention, the space 100 can optionally contain insulation and/or noise-absorbing materials 72 (shown in FIGS. 1A and 1B), piping 198, smoke and/or fire detectors, and/or audio transmitters and receivers, and/or used to move heating or cooling air 196 therethrough. Perforations 70 can be provided in the arcuate portion 92. A pattern of perforations over the entire area of the arcuate portion 92 is believed to achieve superior acoustics (that is acoustical dampening) over the prior art.

Figure 6:
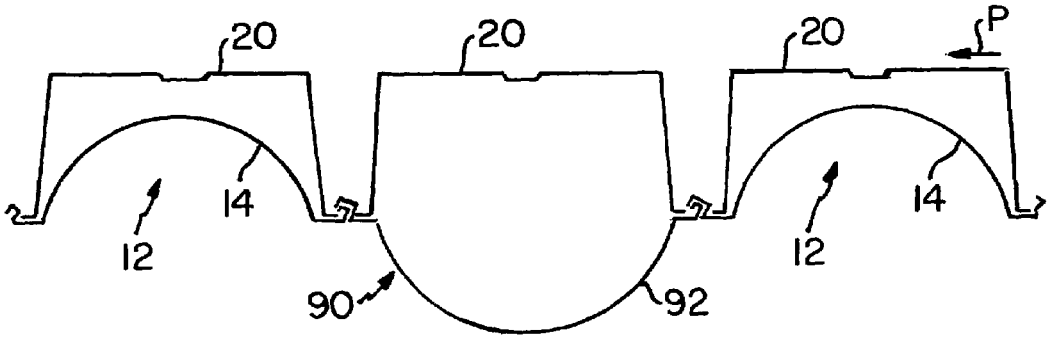
FIG. 6 is an end elevational view of a decking assembly incorporating exposed concave and convex arcuate portions made in accordance with the present invention.
Figure 7:
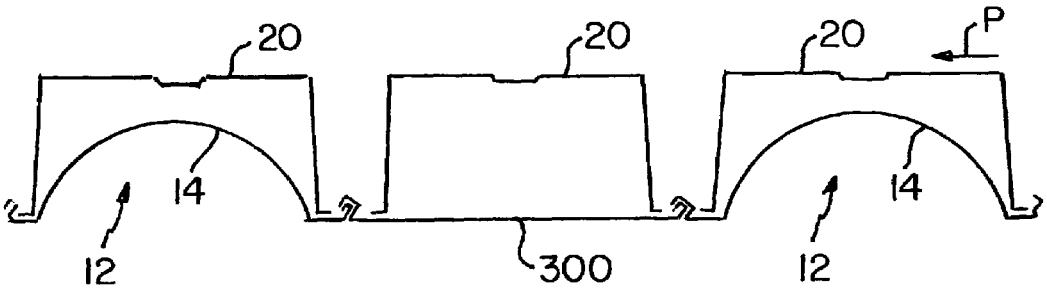
FIG. 7 is an end elevational view of a decking assembly incorporating spaced apart exposed concave arcuate portions separated by a flat portion made in accordance with the present invention.

As shown in FIG. 6, the present invention can include a combination of arcuate portion 14 and arcuate portion 92. In other words, the present invention permits a deck panel assembly 10 formed of a first-type panel and a second-type panel, wherein the first-type panels are different than the second-type panels. FIG. 7 shows a combination of arcuate portions 14 separated by flat deck portions 300 and FIG. 8 shows a combination of arcuate portions 92 separated by flat deck portions 300'.

Figure 8:
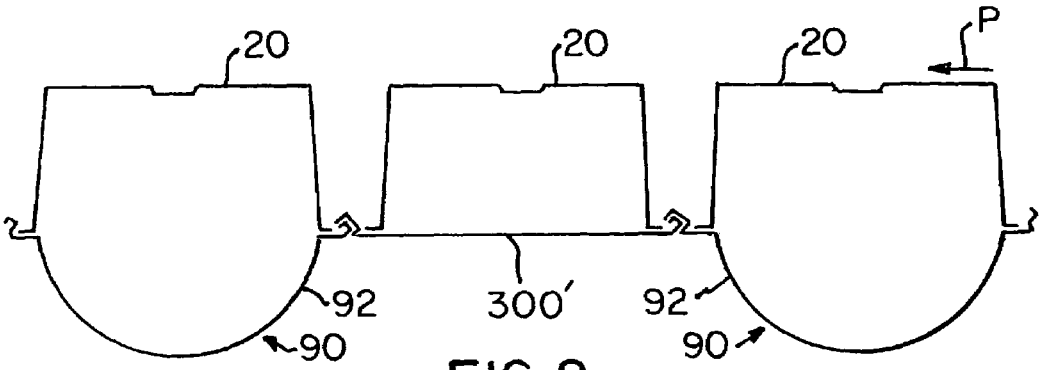
FIG. 8 is an end elevational view of a decking assembly incorporating spaced apart exposed convex arcuate portions separated by a flat portion made in accordance with the present invention.

As can be seen in FIGS. 6-8, the present invention provides an aesthetically pleasing appearance to the observer below the installed deck be it by viewing the arcuate portions 14 and/or arcuate portions 92. Therefore, the present invention utilizes the structural covers 20 to provide primary structural strength of the deck panels 12 and 90.

The present invention achieves decking where the exposed arcuate surface gives a pleasing appearance to the structural deck. Prior art structural decks primarily have a flat plated look, such as shown in flat deck portions 300. The present arrangement provides a varied appearance of the exposed support 13, as shown in FIGS. 9A-9G. FIGS. 9A-9G show various deck panels 12, 12A, 12B, 12C, 12D, 12E, 12F, 12G having different shaped elongated supports 13, 13A, 13B, 13C, 13D, 13E, 13F, 13G and structural covers 20, 20A, 20B, 20C, 20D, 20E, 20F, 20G to form different deck exposed surface appearances.

As is evident, the deck panels provide for arcuate exposed surfaces (be it concave or convex) while the upper surfaces of the bases 38 of the structural covers 20-20G remain substantially flat along a horizontal plane P (see, for example, FIGS. 1A, 2-4, 6-7 and 9A-9G) over their lengths and widths at their uppermost surface of the bases 38 to accommodate typical roof and floor assemblies shown in FIGS. 1A and 3 unlike prior art curved panels such as Epic Metals Corporation's Archdeck® products wherein the complete panel is arcuate and curves along its length, where the panel includes a hat and a plated member (Archdeck® P and Archdeck® PA decking). However, periodic voids 500 may be formed to accommodate placement of conduits or piping, etc. Hence, having substantially flat horizontal upper surfaces of bases results in an easier arrangement to secure flat roofing or pour concrete on top of the structural covers to form flooring and/or roofing while having an arcuate ceiling appearance over prior art arrangements.

Further, the present invention permits the use of structural decking having increased voids V to accept pipe, etc., hidden by supports 13A, 13B, 13C, 13D, 13E, 13F, 13G. See, for example, FIG. 9D that shows a pipe 400 in phantom.

In other words, referring to FIG. 6, the present invention is a deck assembly 10 for forming a ceiling having a pleasing appearance while maintaining desirable strength characteristics. The deck assembly 10 includes a plurality of deck panels such as, for example, 12 and 90, assembled in one or more manner selected from the group of side-by-side, end-by-end, and combinations thereof, and secured to a structural base, at least one of the panels being a deck panel having an exposed arcuate surface such as concave surface 32 or convex surface 94. More specifically, the deck panel includes a ceiling member, i.e., support 13 or support 91, along a longitudinal axis (extending into and out of the page) and an elongated structural cover attached to the ceiling member. The ceiling members 13 and 91 have an arcuate portion that extends along the longitudinal axis having two terminal points 1000 and 1000' that extend along the longitudinal axis. The arcuate portions 14 and 92 include a concave surface 32 or 96 and a convex surface 30 or 94 wherein the elongated structural covers have a substantially flat upper surface portion or base 38 or 97 and two depending legs 34, 36 or 97A, 97B therefrom. As shown in FIG. 6, for example, the substantially flat upper portion or base 38 or 97 can include corrugations or ribs or offsets from a flat plane. Respective ones of the two terminal points 1000 or 1000' of the arcuate portion are attached to the depending legs of the structural cover. By terminal points, it is meant to be the ends of the arcuate portions, such as arcuate portions 14 or 92. As stated above, one of the concave surface and the convex surface is exposed defining a ceiling exposed surface 1002, wherein a projected area 1004 and 1006 (as illustrated by the phantom hatch marks) is defined between the sides of the exposed surface, wherein the only portion of the deck panel contained in the projection is the concave surface or the convex surface of the ceiling exposed surface, so that a ceiling formed of a plurality of deck panels has a pleasing appearance when viewing the ceiling from underneath the deck panel as represented by reference numeral 1008.

As can be seen in FIG. 6, the structural cover 20 has an uppermost portion 1010 and a lowermost portion 1012, wherein at least a portion of the arcuate portion 96 is positioned below the lowermost portion 1012. As can be seen, the extensions on the structural cover 20 extend outwardly.

Figure 9G:
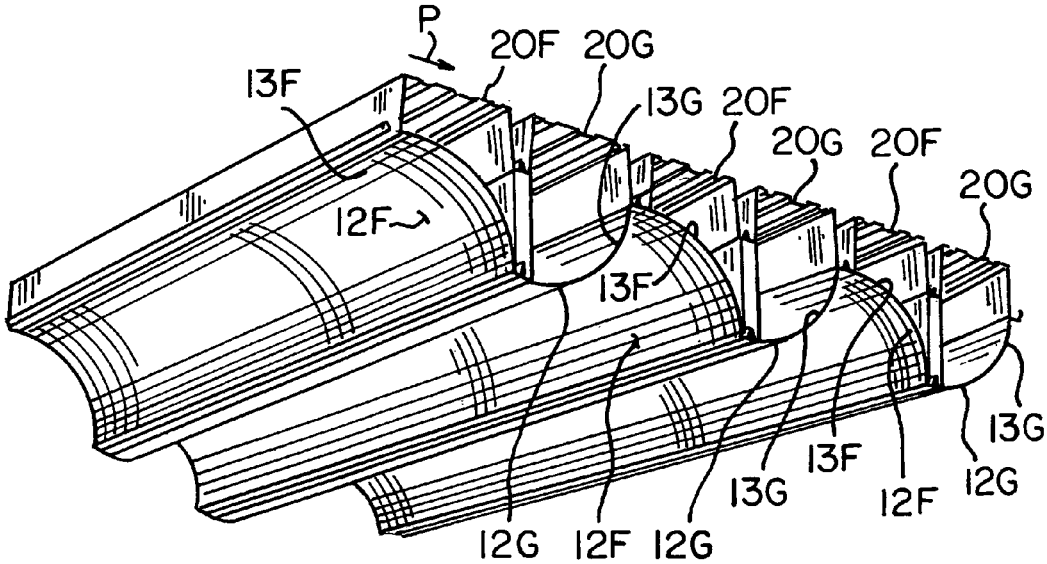

As can be appreciated by FIGS. 6-9G, the deck panels of the present invention can be combined in many arrangements, for example as shown in FIGS. 6 and 9A, adjacent deck panels can be combined to form a substantially continuous curved surface. Also, FIG. 9G shows panel structural covers having differing leg lengths. As can be seen in FIGS. 9A-9G, the arcuate portion can directly contact the structural cover. Also, FIG. 9B shows exposed arcuate surfaces of a deck assembly having different radii to give a different appearance.

While the preferred embodiment of the invention has been described herein, it is to be understood that the invention may be otherwise embodied within the scope of the appended claims.

What is claimed is:

1. A method for making a ceiling from deck panels, comprising the steps of:

(a) providing a plurality of deck panels comprising a ceiling portion and a structural cover, the structural cover extending beyond the ceiling portion, wherein at least two of said panels have different ceiling exposed surfaces and one of said exposed surface is arcuate; and (b) attaching said structural covers to a structural frame.

2. A deck panel for forming a ceiling comprising a ceiling member having an arcuate portion coacting with an elongated structural cover, the elongated structural cover having an uppermost portion and a lowermost portion, wherein at least a portion of the arcuate portion of the ceiling is positioned below the lowermost portion of the structural cover.

3. A deck panel comprising:

a support having a pair of opposed sides and opposed ends, the support having an arcuate portion, the arcuate portion having a convex surface and an opposite concave surface; and an elongated structural cover over the arcuate portion and directly contacting the arcuate portion.

4. A deck panel comprising:

a support having a pair of opposed sides and opposed ends, the support having an arcuate portion, the arcuate portion having a convex surface and an opposite concave surface; and an elongated structural cover over the arcuate portion and attached to the support, the structural cover comprising two spaced apart, outwardly extending extensions for coacting with adjacent deck panels.

* * * * *